US005609510A

United States Patent [19]

Stubenfoll et al.

[11] Patent Number: 5,609,510

[45] Date of Patent: Mar. 11, 1997

[54] TOY VEHICLE WITH A CHASSIS-BENDING MECHANISM

[75] Inventors: Leonard Stubenfoll, Oak Brook, Ill.; Zenichi Ishimoto, Tokyo, Japan

[73] Assignee: Fertig Stubenfoll Design Group, Inc., Oak Brook, Ill.

[21] Appl. No.: 450,708

[22] Filed: May 25, 1995

[30] Foreign Application Priority Data

May 25, 1994 [JP] Japan ..... 6-111478

[51] Int. Cl.[6] ..... A63H 33/04; A63H 17/00; A63H 17/26

[52] U.S. Cl. ..... 446/456; 446/437; 446/470

[58] Field of Search ..... 446/427, 424, 446/443, 433, 431, 437, 456, 457, 462, 465, 466, 470, 471, 356

[56] References Cited

U.S. PATENT DOCUMENTS

| | | | |
|---|---|---|---|
| 2,832,426 | 4/1958 | Seargeant | 446/433 X |
| 2,918,738 | 12/1959 | Barr | 446/356 X |
| 4,508,516 | 4/1985 | D'Andrade et al. | 446/443 |
| 4,516,952 | 5/1985 | Brand et al. | 446/427 |
| 4,882,842 | 11/1989 | Hamilton | 446/456 X |
| 4,943,256 | 7/1990 | Symons | 446/456 X |
| 5,052,680 | 10/1991 | Malewicki et al. | 446/465 X |
| 5,135,427 | 8/1992 | Suto et al. | 446/433 |
| 5,243,708 | 9/1993 | Allen | 446/356 |
| 5,261,853 | 11/1993 | Suto | 446/433 |

FOREIGN PATENT DOCUMENTS

| | | | |
|---|---|---|---|
| 3008604 | 9/1981 | Germany | 446/456 |
| 2182859 | 5/1987 | United Kingdom | 446/471 |

*Primary Examiner*—Robert A. Hafer
*Assistant Examiner*—D. Neal Muir
*Attorney, Agent, or Firm*—Young & Thompson

[57] ABSTRACT

The invention provides A toy vehicle comprising a body being divided into two parts on front and rear sides, a chassis being divided into two parts on front and rear sides on which the front and rear side body parts are mounted respectively, the front and rear side chassis parts being so coupled with each other as to bend those at its coupling portion in upward and downward directions, driving mechanisms for coupling front and rear tires on left side with front and rear tires on right side respectively which are provided to the chassis, driving motors being engaged with the left and right side driving mechanisms respectively and a controller for controlling the driving motors to allow the left side front and rear tires and the right side front and rear tires to rotate mutually in the same direction or in opposite directions.

8 Claims, 8 Drawing Sheets

TOY VEHICLE WITH A CHASSIS-BENDING MECHANISM

BACKGROUND OF THE INVENTION

This invention relates to a toy vehicle designed to be capable of showing attractive performances in traveling, and more particularly to a toy vehicle controlled by a radio-remote control means or a wire-remote control means, which is quickly permitted to turn left and right directions to improve its performance of travelling on a bad road or against obstacle.

In a conventional toy vehicle, it was known that a toy vehicle is designed to have attractive shapes and capability of showing attractive performances in traveling, in which a chassis of the toy vehicle is divided into two parts which are coupled with each other and front and rear tires are separately controlled by a control means. For instance, there was proposed the toy vehicle that its chassis is divided into front and rear parts which may be slightly bent each other, thereby improving a suspension mechanism of the rear chassis. This toy vehicle has general functions which make the toy vehicle go toward and backward and turn left and right directions. Notwithstanding, any further special function is not provided to the conventional toy vehicle.

However, if the conventional toy vehicles hit or face to a body-sized obstacle or an escarpment, it is absolutely prevented to have the toy vehicle go forward, for which reason it is immediately needed to have the toy vehicle go back by changing the direction in traveling. For the conventional toy vehicle, there is such the limit in the travelling performance on off road. In case of dividing the chassis of the toy vehicle, for obtaining a structure of four wheel drive (4WD), it is necessary to contrive a structure for coupling a driving mechanisms of the tires to each divided parts of chassis since a timing for driving front and rear tires must be synchronized with each other. Thus, there are disadvantages in adopting the above structure to the toy vehicle in that steps for fabricating the toy vehicle become complicated and costs therefor are increased. On the other hand, it can be proposed that individual driving motors are provided to the front and rear tires respectively. However, a control means becomes complicated for synchronizing the individual driving motors associated with the front and rear tires and a vehicle weight is increased because of increasing the number of the motors to be used therein.

SUMMARY OF THE INVENTION

Accordingly, it is an object of the present invention to provide a novel toy vehicle in which front and rear side parts of the chassis are bent each other to shorten a distance between front tires and rear tires wherein the front and rear tires are controlled by use of two driving motors to allow the toy vehicle to turn left and right, thereby removing or getting over a comparatively big obstacle by bending the front and rear parts of the chassis of the toy vehicle and thereby suddenly turning the toy vehicle to evade the obstacle for getting smooth traveling.

It is a further object of the present invention to provide a novel toy vehicle in which a coupling portion of divided bodies and chassis is forcibly bent by adding a driving motor and in which an overhanging member is provided to a front end of the chassis to be able to remove or carry an obstacle by bending the divided bodies and chassis of the toy vehicle.

The above and other objects, features and advantages of the present invention will be apparent from the following descriptions.

In accordance with the invention, there is provided a toy vehicle comprising a body being divided into two parts comprising front and rear side bodies, a chassis being divided into front and rear side parts on which the front and rear side body are mounted respectively, the front and rear parts of the chassis being coupled with each other to be bent at a coupling portion in upward and downward directions, driving mechanisms for coupling front and rear tires on left side with front and rear tires on right side respectively which are provided to the chassis, driving motors being engaged with the left and right side driving mechanisms respectively and a control unit for controlling the driving motors thereby allowing front and rear tires on the left and right sides either in the same direction or in the opposite directions to show mutual rotations.

It is preferred that the front side part of the chassis is coupled to the rear side body through a elastic member which always gives a recovery function for recovering the front and rear side parts of the bodies and chassis being bent.

It is also preferred that the front side body or chassis is provided with an overhanging member for removing and carrying an obstacle.

It is also preferred that the coupling portion where the front and rear side chassis are coupled with each other is provided with a bending mechanism which controls bending actions of the bodies and chassis by a driving mechanism having a driving motor.

It is also preferred that the driving mechanisms for coupling front and rear tires on the left side with front and rear tires on the right side respectively comprise bilateral symmetric gear mechanisms with respect to a longitudinal direction of the chassis.

It is also preferred that the control unit for controlling rotation of front and rear tires on the left and right sides allows the left and right side tires to show mutual rotations in the same direction as travelling of the toy vehicle towardly or backwardly, or in the opposite directions to turn toy vehicle quickly in left or right direction.

It is also preferred that the driving mechanisms having the driving motors are controlled by a radio-remote control means or a wire-remote control means.

BRIEF DESCRIPTION OF THE DRAWINGS

Preferred embodiments of the present invention will hereinafter fully be described in detail with reference to the accompanying drawings.

FIG. 7 is a partial cross sectional plan view taken on a line VII—VII, wherein

PREFERRED EMBODIMENTS OF THE INVENTION

An embodiment of a toy vehicle according to the present invention will be described with reference to drawings.

Figure 1:
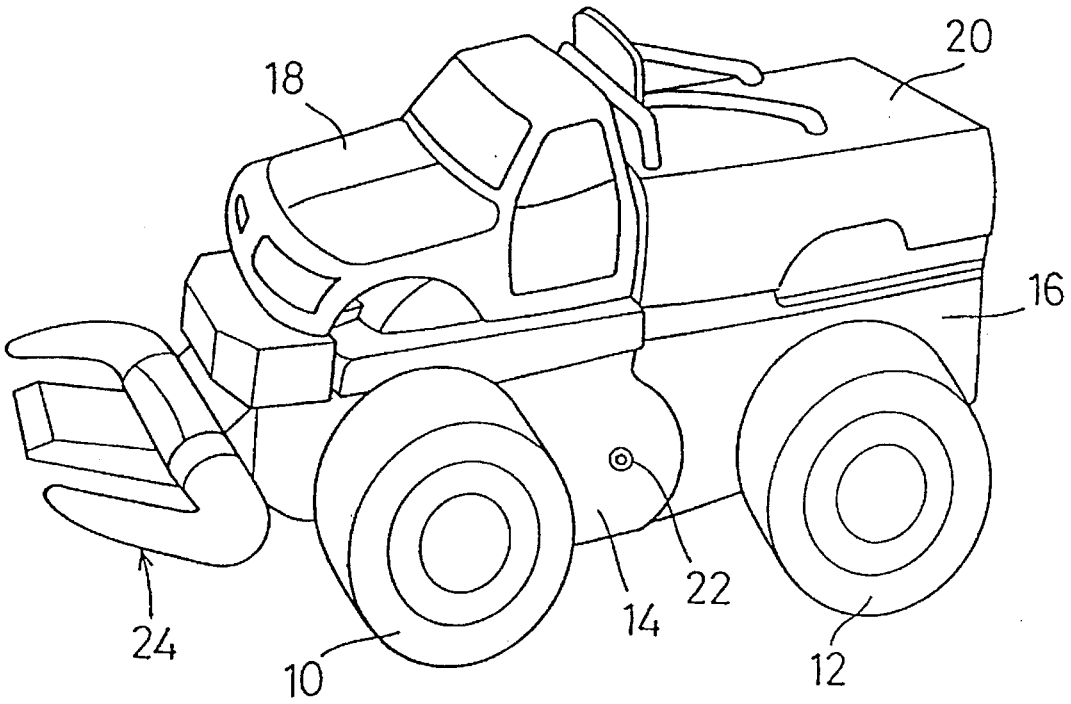
FIG. 1 is a perspective view showing a toy vehicle in the normal running form in one embodiment according to the invention.
Figure 2:
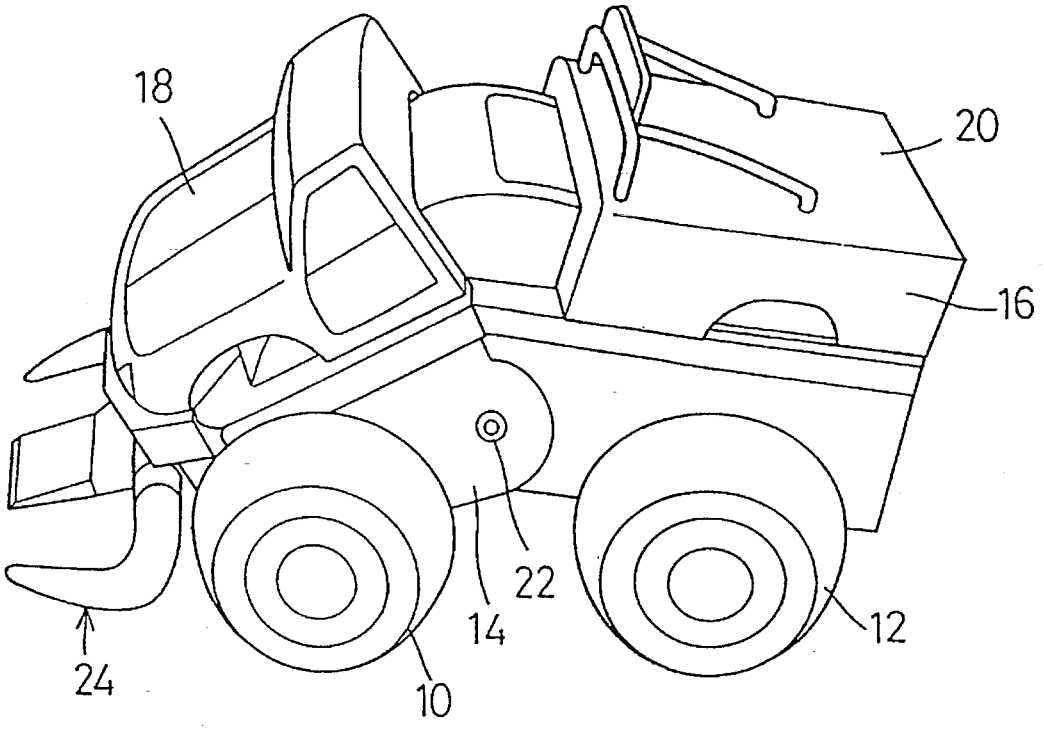
FIG. 2 is a perspective view showing a toy vehicle as shown in FIG. 1 wherein its chassis is bent.

FIG. 1 and 2 are perspective views showing the toy vehicle of the embodiment according to the invention. FIG. 1 shows the toy vehicle in a normal running form and FIG. 2 shows the toy vehicle in which a chassis of the toy vehicle bent. In FIGS. 1 and 2, the numerical reference 10 represents front tires and the numerical reference 12 represents rear tires. A chassis of the toy vehicle is divided into front and rear side parts 14 and 16. The front tires 10 are provided to the front side part 14 and the rear tires 12 are also provided to the rear side part 16. A body of the toy vehicle is also divided into front and rear side parts 18 and 20 which are, then, mounted on the front and rear side parts 14 and 16 respectively.

In the toy vehicle of the embodiment, the front and rear side parts 14 and 16 are coupled to each other by a shaft member 22 to allow them to be bent mutually. At a front end of the front side part 14, an overhanging member 24 is provided to be able to swing upward and downward directions for removing or carrying an obstacle existing in front of the toy vehicle.

Figure 3:
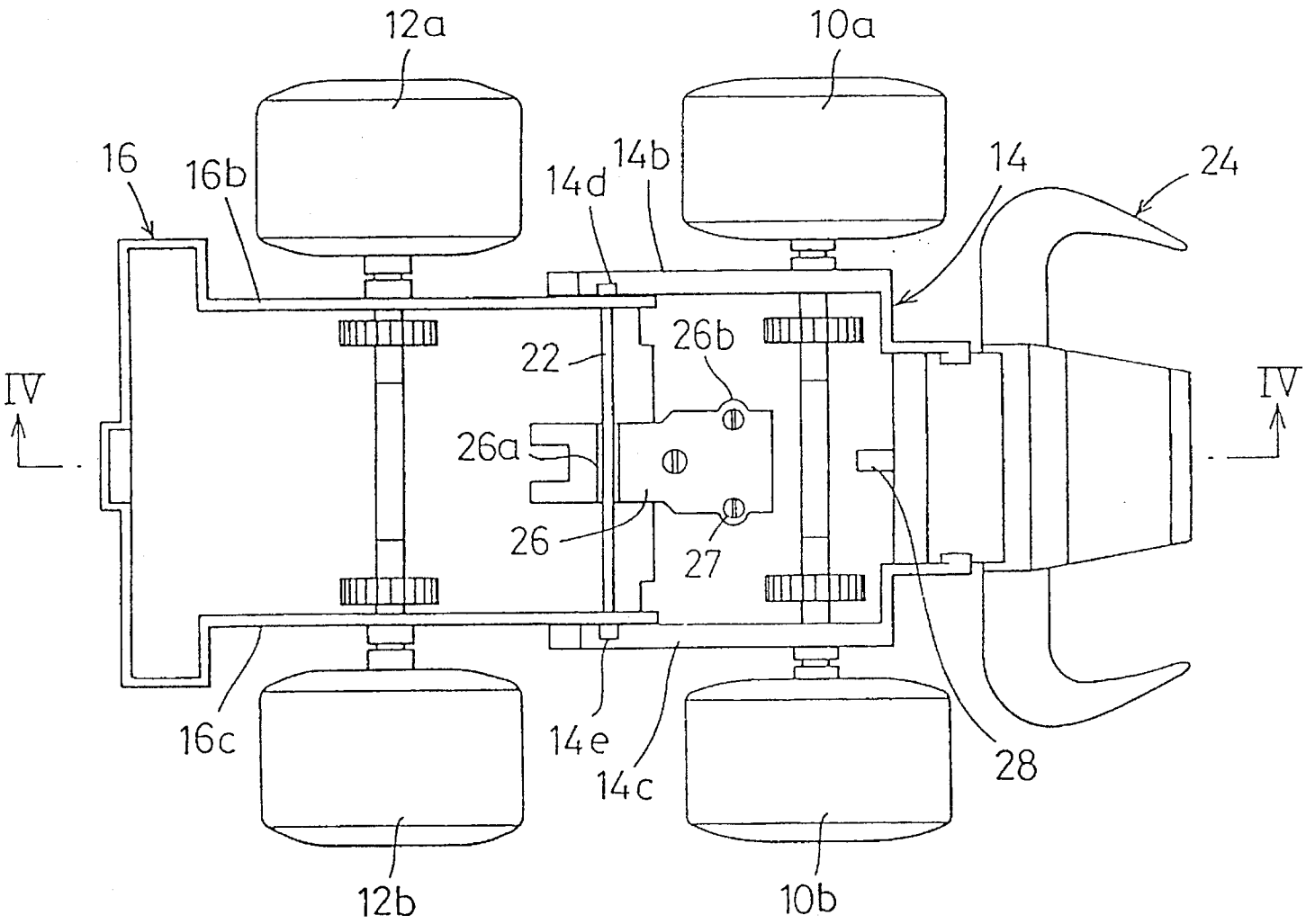
FIGS. 3 is a plan view showing a coupling mechanism for coupling divided chassis of a toy vehicle showing in FIG. 1.
Figure 4:
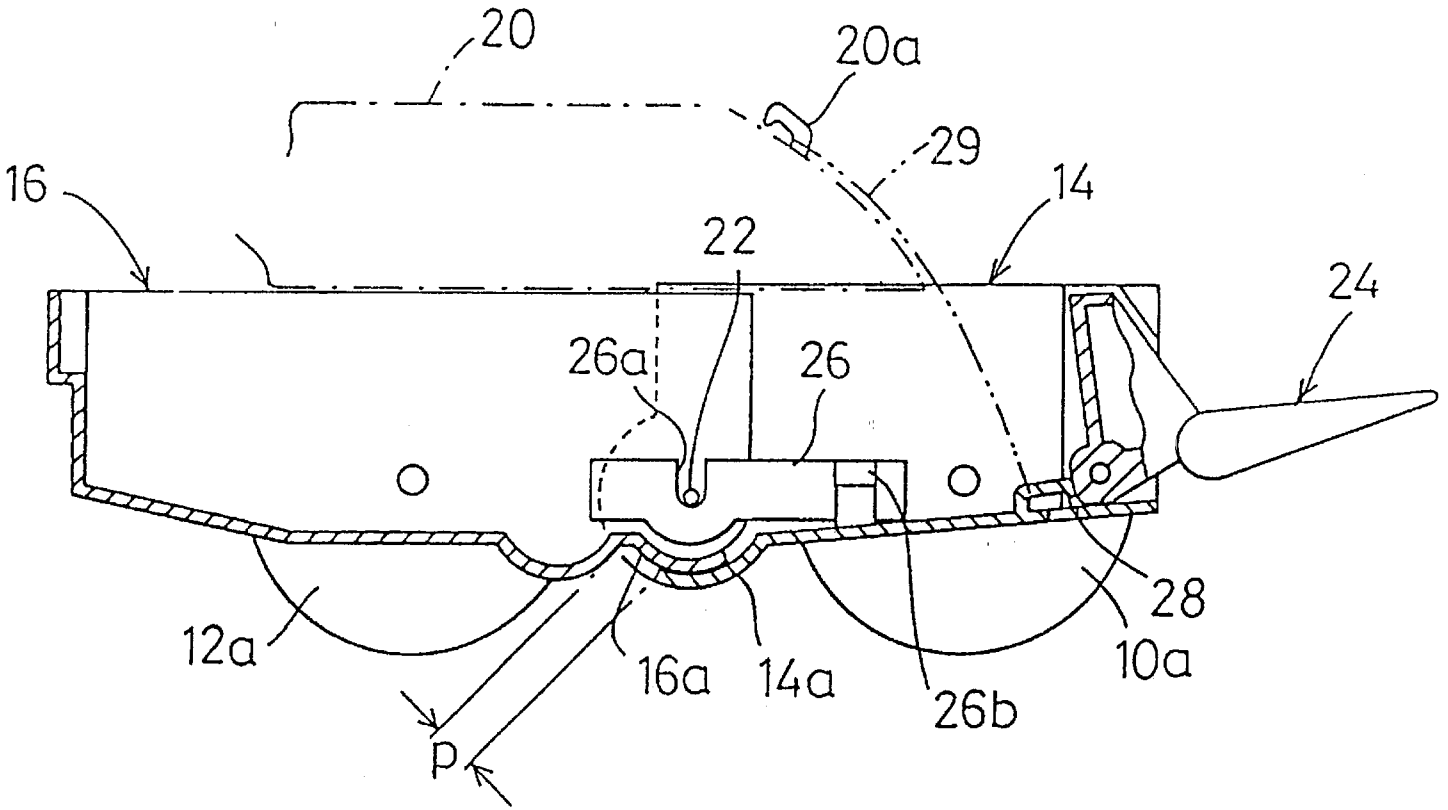
FIG. 4 is a partial cross sectional view taken on a line IV—IV.

A coupling mechanism coupling the front and rear side parts 14 and 16, and front and rear side parts 18 and 20 will be described in more detail. FIGS. 3 and 4 illustrate a structure for coupling the front and rear side parts 14 and 16 in case of detaching the front and rear side parts 18 and 20 from the front and rear side parts 14 and 16. From FIGS. 3 and 4 illustrations a driving mechanism and the like to be provided in the chassis are omitted.

A coupling portion of the front side part 14 having the front tires 10*a*, 10*b* at its leer and right side and the rear side part 16 having rear tires 12*a*, 12*b* at its left and right side comprises to hold a front end portion of the rear side part 16 in a rear end portion of the front side part 14. Concretely, a bottom portion 16*a* of the front end portion of the rear side part 16 is formed to have a curved shape in a cross section and a bottom portion 14*a* of the rear end portion of the front side part 14 is also formed to have a curved shape in a cross section to fit into the curved shape bottom portion 16*a*. For coupling the front and rear side parts 14 and 16, a coupling member 26 is used, one end of which is attached to a center axis along the longitudinal direction of the front side part 14 and another end of which is extended to the rear side part 16. A channel portion 26*a* extending in a transverse direction of the rear side part 16 is formed to the extended portion of the coupling member 26. Then, the shaft member 22 is inserted into the channel portion 26*a* of the coupling member 26, both ends of which are rotatably connected to side walls 16*b*, 16*c* standing from left and right side portions of the rear side part 16 and shortly protruded from the side walls 16*b*, 16*c* to connect with them pivotly. While channel portions 14*d*, 14*e* extending along a longitudinal direction of the front side part 14 are provided at inner faces of side walls 14*b*, 14*c* standing from left and right side portion of the front side part 14.

The coupling member 26, as constructed above, is previously engaged with the rear side part 16 by the shaft member 22. The front side part 14 is fitted through the shaft member 22 around the rear side part 16, after which a fixed portion 26*b* of the coupling member 26 is fixed through fasteners 27 on the front side part 14, thereby bendably coupling the front side part 14 with the rear side part 16 through the shaft member 22 used as a supporting axis. A bent angle between the front and rear side part 14 and 16 are determined by a distance "P" by which the curved bottom portion 14*a* of the front side part 14 can move on the curved bottom portion 16*a* of the rear side part 16, as shown in FIG. 4.

In the toy vehicle of the embodiment, the front and rear side bodies 18 and 20 are attached on the front and rear side parts respectively as shown by a dotted line in FIG. 4, in which a front end portion of the rear side body 20 is extended over the front side part 14. A coupling member 20*a* is provided to the front end portion of the rear side body 20 and a coupling member 28 is also provided to a front end bottom portion of the front side part 14. An elastic member 29 is provided between the coupling members 20*a* and 28, in which a predetermined tension is given between them to couple them each other. According to the above structure, the front side part 16 is always elastically pulled toward the rear side body 20. Therefore, when the front and rear side parts 14 and 16 are bent toward each other, an elastic function can be given by the elastic member 29 to the front and rear side parts 14 and 16 for automatically returning a horizontal state of them.

Figure 5:
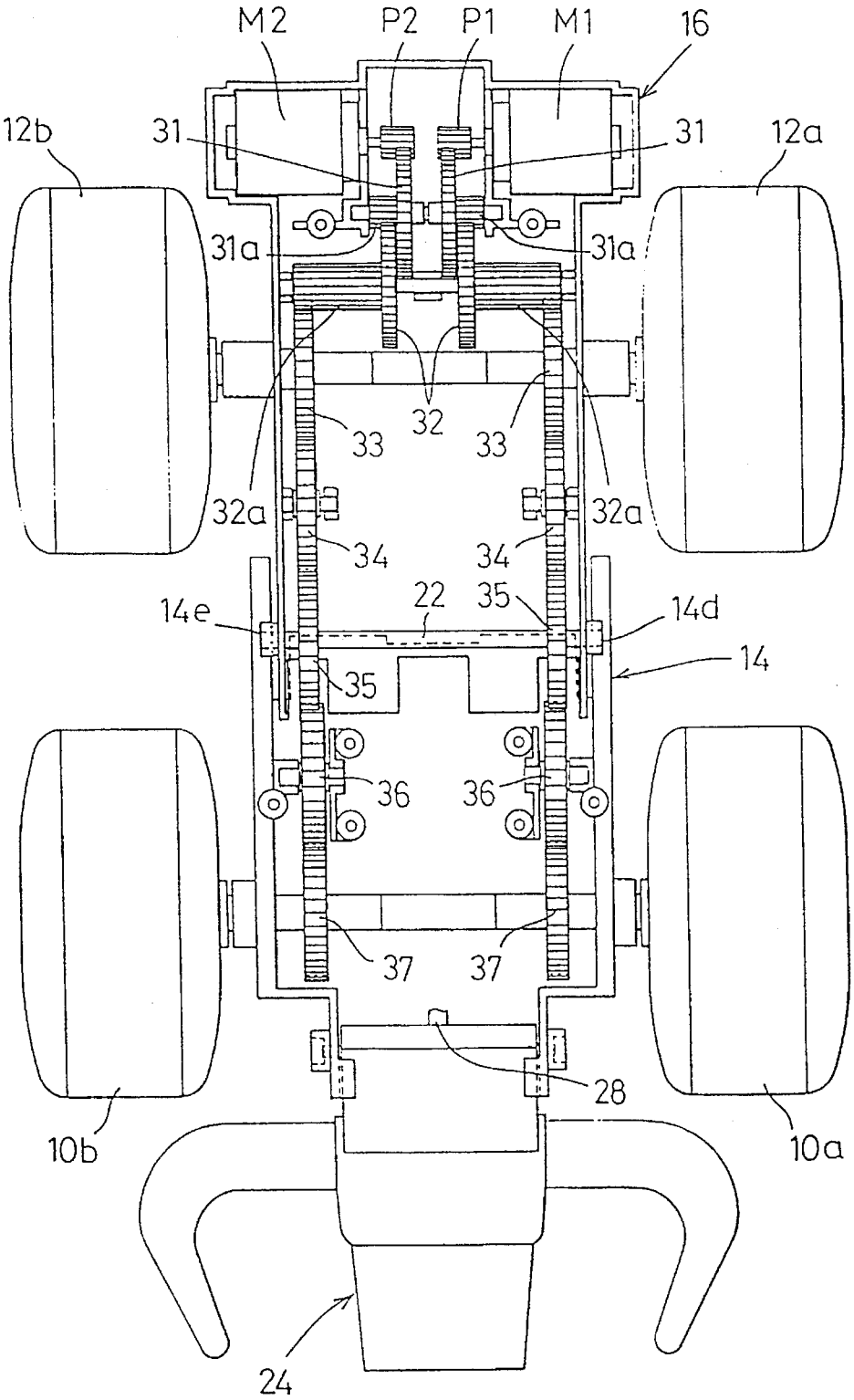
FIG. 5 is a plan view showing a driving mechanism for front and rear tires, which are put in a chassis of the toy vehicle shown in FIG. 1.

A driving mechanism of the front and rear tires 10 and 12 of the embodiment according to the invention will be described as follows. FIG. 5 shows the driving mechanism for driving the left and right side front tires 10 provided to the front side part 16 and the left and right rear tires 12 provided to the rear side part 16 respectively. Note that the structure other than the driving mechanism is omitted from FIG. 5. In FIG. 5, two motors M1 and M2 are used for the toy vehicle of the embodiment, in which the front and rear tires 10*a* and 12*a* of the left side of the parts 14 and 16 are connected through a series of the gear mechanism 30*a* to be engaged with the motor M1, while the front and rear tires 10*b* and 12*b* of the right side of the parts 14 and 16 are connected through a series of the gear mechanism 30*b* to be engaged with the motor M2. The gear mechanisms 30*a* and 30*b* comprise bilaterally symmetric gear mechanism with respect to a longitudinal direction of the parts 14 and 16.

Each of the gear mechanisms 30*a* and 30*b* as shown in FIG. 5 comprises a first gear 31, a second gear 32, a third gear 33, a fourth gear 34, a fifth gear 35, a sixth gear 36 and a seventh gear 37. The first gear 31 is engaged with a pinion portion P1 (or P2) coupled with a rotating shaft of the motor M1 (or M2) and the second gear 32 is engaged with a pinion portion 31*a* of the first gear 31. The third gear 33 is engaged with a pinion portion 32*a* of the second gear 32 and a rotating shaft (not shown) of the third gear 33 is coupled with the rear tire 12*a* (or 12*b*) to make it rotate. Then, the forth gear 34, the fifth gear 35, the sixth gear 36 and the seventh gear 37 which have the same structure as the third gear 33 are in order engaged with the third gear 33 and a rotating shaft (not shown) of the seventh gear 37 is coupled with the front tire 10*a* (or 10*b*). According to the above structure, corresponding left and right side front tires 10*a* and 10*b* and rear tires 12*a* and 12*b* can be synchronized to be driven by the driving motor M1 and M2.

Figure 6:
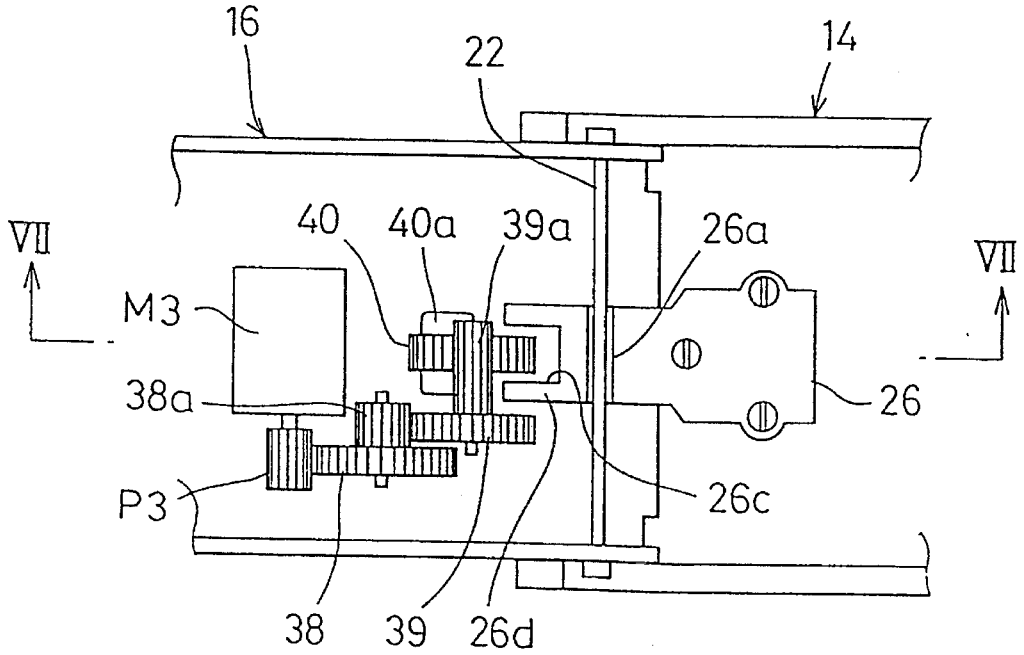
FIG. 6 is a plan view showing a controlling mechanism for bending a coupling portion of chassis divided in two parts of a toy vehicle shown in FIG. 1.
Figure 7A:
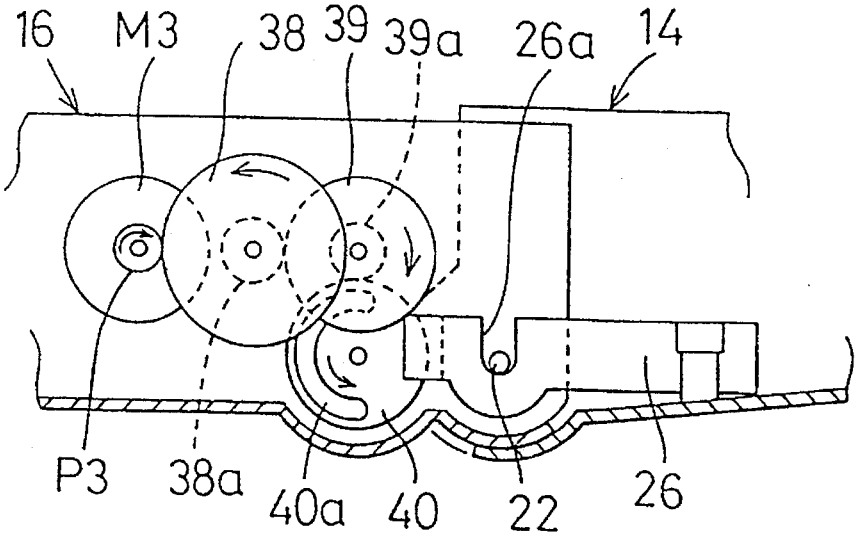
FIG. 7A is a partial cross sectional view showing a state before bending action and FIG. 7B is a partial cross sectional view showing state in bending chassis.
Figure 7B:
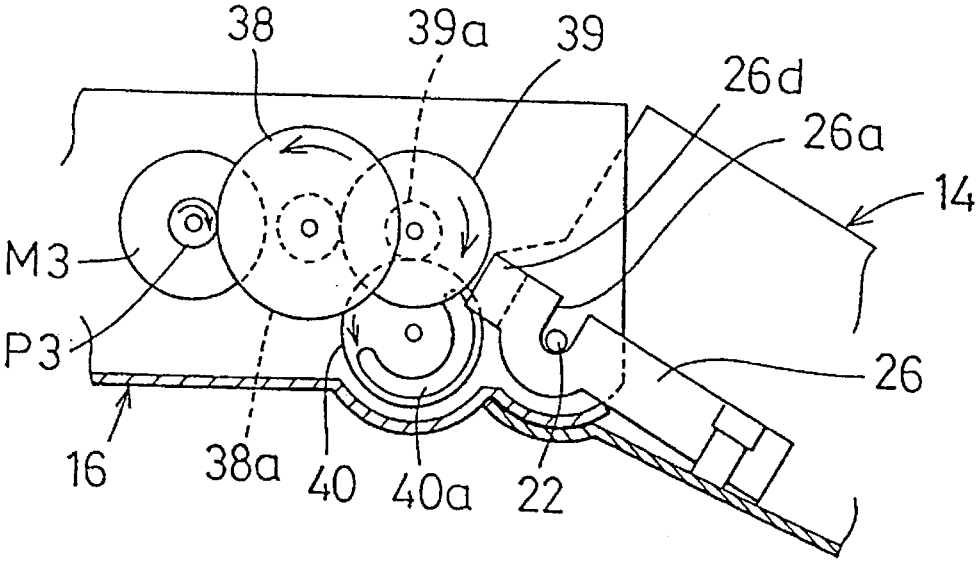

A bending action at the coupling portion of the front and rear side parts 14 and 16 of toy vehicle of the embodiment will be described as follows, in which the bending action is forcibly performed by a control mechanism to be controlled by a radio-remote control. FIGS. 6, 7A and 7B show the coupling portion of the front and rear side parts 14 and 16 as shown in FIGS. 3 and 4. In FIGS. 6, 7A and 7B, the control mechanism is provided with a third driving motor M3, in which a first gear 38 is engaged with a pinion portion P3 coupled with the rotating shaft of the driving motor M3, a second gear 39 is engaged with a pinion portion 38*a* of the first gear 38, a third gear 40 which is provided with a cam portion 40*a* is engaged with a pinion portion 39*a* of the second gear 39 and the cam portion 40*a* comes in contact with one end of the coupling member 26 provided to the coupling portion. The one end of the coupling member 26 is provided with a concave portion 26*c* which can receive a part of the third gear 40, both ends of which are instituted as cam follower portions 26*d*. The cam portion 40*a* comes in contact with the cam follower portions 26*d* of the coupling member 26 every a half rotation of the third gear 40 to raise it up so that the front and rear side parts 14 and 16 can be forcibly bent with each other at the coupling portion by the radio-remote control (see FIG. 7B).

The toy vehicle of the invention having the above structure will be described about an operation for control and a driving state.

Figure 8:
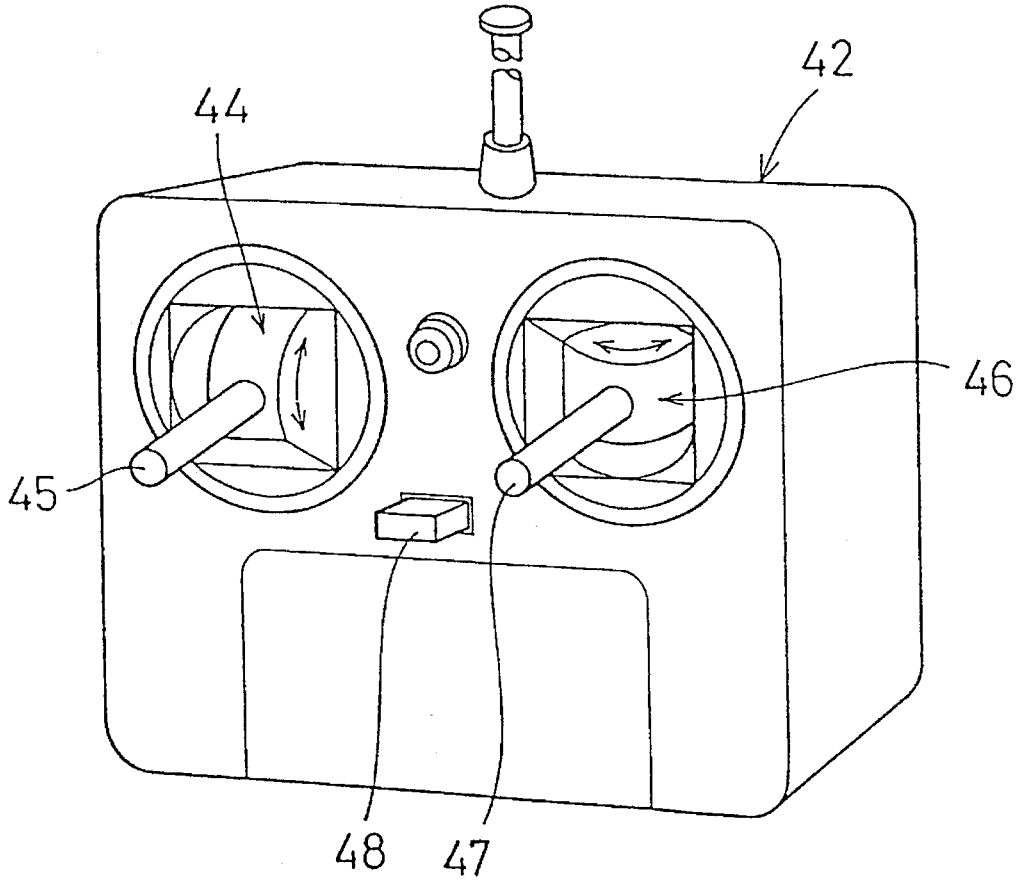
FIG. 8 is a perspective view showing a radio-control signal transmitter for transmitting radio control signals to a toy vehicle of the invention.

The toy vehicle as shown in FIGS. 1 and 2 is provided with a receiver receiving a remote-control signal and a battery for controlling and driving the driving motors M1 to M3 similar to a conventional radio-controlled toy vehicle, while a transmitter for transmitting the radio-control signal to the receiver is prepared. As shown in FIG. 8, the transmitter 42 is provided with, for instance, a first operating portion 44, a second operation portion 46 and a third operation portion 48.

The first operating portion 44 is used for driving the first and second driving motors M1 and M2 which are mutually and reversibly made to rotate in the same direction. The first operating portion 44 is provided with a operating lever 45 which is allowed to move upward and downward directions. When the operating lever 45 is moved upward direction, the toy vehicle go forward direction, while when the operating lever 45 is moved downward direction, the toy vehicle go backward direction.

The second operating portion 46 is used for driving the first and second driving motors M1 and M2 which are mutually and reversibly made to rotate in opposite directions. The second operating portion 46 is provided with an operating lever 47 which is allowed to move left and right directions. When the operating lever 17 is moved to left direction, the toy vehicle turns left suddenly, while when the operating lever is moved to right direction, the toy vehicle turns right suddenly.

The third operating portion 48 is used for driving the third driving motor M3. The third operating portion 48 comprises a push button, thereby pushing the button to be able to operate the coupling portion coupling the first and second side parts 14 and 16. As a result, the front and rear body 18 and 20 are forcibly bent by the radio-remote control as shown in FIG. 2, while are forcibly returned a horizontal state as shown in FIG. 1.

In the control of the toy vehicle, the radio-remote control means may be replaced by a wire-remote control means.

According to the toy vehicle of the invention, it comprises a body being divided into front and rear side parts, a chassis being divided into front and rear side parts on which the front and rear side body are mounted respectively, the front and rear parts of the chassis being coupled with each other to be able to bend them at its coupling portion in upward and downward directions, driving mechanisms for coupling left side front and rear tires and right side front and rear tires respectively which are provided to the chassis, driving motors being engaged with the left and right side driving mechanisms respectively and a controller for controlling the driving motors thereby making the left side front and rear tires and the right side front and rear tires rotate mutually in same direction or in opposite directions so that the toy vehicle is made to go toward and backward directions and to turn to left and right directions. In addition, the front and rear side parts are forcibly bent with each other by the radio-remote control means.

When the toy vehicle meets with the obstacle, the divided bodies and chassis are bent with each other to get over the obstacle or to turn left and right suddenly. Therefore, it can be obtained for the toy vehicle to run smoothly on the bad road where many obstacle are existing.

Further, the coupling portion is provided with the bending mechanism so that the divided bodies and chassis are easily bent with each other by the radio-remote control means, thereby obtaining a very attractive toy vehicle.

In the toy vehicle of the invention, the overhanging member can swing upward and downward or kick something by utilizing the above bending mechanism.

According to the overhanging member, the obstacle can be moved or carried to another place so that the toy vehicle is available for some games, which, for instance, two toy vehicle are opposite to each other and then they are made to collide with each other to knock other toy vehicle down, and a ball is kicked to enter into a goal by use of some toy vehicle.

Whereas modifications of the present invention will no doubt be apparent to a person of ordinary skilled in the art to which the invention pertains, it is to be understood that the embodiments shown and described by way of illustration are by no means intended to be considered in a limiting sense. Accordingly, it is to be intended by the claims to cover all modifications of the invention which fall within the spirit and scope of the invention.

What is claimed is:

1. A chassis bending mechanism in a toy vehicle having a chassis divided in a longitudinal direction into first and second parts which are hinged to each other, wherein said chassis bending mechanism comprises:

a shaft which is fixed to said second part of said chassis, said shaft extending in a horizontal direction which is perpendicular to said longitudinal direction;

a connection member comprising first and second portions unitarily formed, said first and second portions of said connection member respectively extending over said first and second parts of said chassis, said first portion of said connection member being fixed to said first part of said chassis, said connection member having a recess at a boundary between said first and second portions for receiving said shaft so that said connection member and said first and second chassis parts pivot around said shaft;

a motor for generating a rotation force, said motor mounted in said chassis;

a transmission gear mechanism being mechanically connected to said motor for transmitting said rotation force;

a disk-like member being rotatably provided on said chassis, said disk-like member being positioned adjacent to said second portion of said connection member, said disk-like member being engaged with said transmission gear mechanism for receiving said rotation force, said disk-like member being provided on one side with a projection which projects in said horizontal direction and extends over a part of a peripheral portion of said disk-like member so that a rotation of said disk-like member forces said projection into contact with and push up said second portion of said connection member to have said connection member and said first and second chassis parts rotate around said shaft whereby said second portion of said connection member is forced above said shaft whilst said first portion of said connection member fixed to said chassis first part is forced below said shaft to thereby direct said first part of said chassis downward and bend said chassis at said boundary.

2. The chassis bending mechanism as claimed in claim 1, wherein said first and second parts of said chassis have first and second curved ends, respectively which slidably fit with each other so as to allow said first and second parts of said chassis to be hinged by said first and second curved ends.

3. The chassis bending mechanism as claimed in claim 1, wherein said disk-like member comprises a gear being engaged with said transmission gear mechanism.

4. The chassis bending mechanism as claimed in claim 1, wherein said projection extends almost a half of said peripheral portion of said disk-like member.

5. A toy vehicle comprising:

a chassis divided in a longitudinal direction into front and rear parts which are hinged to each other;

a body on said chassis;

front tires on said first part of said chassis;

rear tires on said rear part of said chassis;

a driving motor on said rear part of said chassis;

a driving power transmission gear mechanism connected to said driving motor and also connected to at least any one of said front and rear tires for driving the same; and, a chassis bending mechanism for bending said chassis at a boundary between said front and rear parts, wherein said chassis bending mechanism comprises:

a shaft which is fixed to said rear part of said chassis, said shaft extending in a horizontal direction which is perpendicular to said longitudinal direction;

a connection member comprising front and rear portions unitarily formed and extending over said front and rear parts respectively of said chassis, said front portion of said connection member being fixed to said front part of said chassis, said connection member having a recess at a boundary between said first and second portions for receiving said shaft so that said connection member pivots around said shaft;

a subordinate motor for generating a rotation force;

a transmission gear mechanism mechanically connected to said subordinate motor for transmitting said rotation force; and a disk-like member rotatably provided on said chassis, said disk-like member being positioned adjacent to said rear portion of said connection member, said disk-like member being engaged with said transmission gear mechanism for receiving said rotation force, said disk-like member being provided on one side with a projection which projects in said horizontal direction and extends over a part of a peripheral portion of said disk-like member so that a rotation of said disk-like member forces said projection into contact with and push up said rear portion of said connection member to have said connection member and said first and second chassis parts rotate around said shaft whereby said rear portion of said connection member is forced above said shaft whilst said front portion of said connection member fixed to said front part is forced below said shaft to thereby direct said front part of said chassis downward and bend said chassis at said boundary.

6. The toy vehicle as claimed in claim 5, wherein said front and rear parts of said chassis have front and rear curved ends which slidably fits with each other so as to allow said first and second parts of said chassis to be hinged by said first and second curved ends.

7. The toy vehicle as claimed in claim 5, wherein said disk-like member comprises a gear being engaged with said transmission gear mechanism.

8. The toy vehicle as claimed in claim 5, wherein said projection extends almost a half of said peripheral portion of said disk-like member.

* * * * *